US006520397B1

(12) United States Patent
Moeller

(10) Patent No.: US 6,520,397 B1
(45) **Date of Patent: *Feb. 18, 2003**

(54) COMBUSTION POWERED TOOL WITH IMPROVED COMBUSTION CHAMBER FAN MOTOR SUSPENSION

(75) Inventor: Larry Moeller, Mundelein, IL (US)

(73) Assignee: Illinois Tool Works Inc., Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,284

(22) Filed: Dec. 22, 1997

(51) Int. Cl.[7] ..... B25C 5/06

(52) U.S. Cl. ..... 227/130; 227/8; 227/10; 123/46

(58) Field of Search ..... 227/130, 8, 10

(56) References Cited

U.S. PATENT DOCUMENTS 2,953,117 A * 9/1960 Wandel et al. ..... 227/130
4,403,722 A 9/1983 Nikolich ..... 227/8
4,483,473 A 11/1984 Wagdy ..... 227/8
4,483,474 A 11/1984 Nikolich ..... 227/8
4,522,162 A 6/1985 Nikolich ..... 123/46.5
RE32,452 E 7/1987 Nikolich ..... 123/46
5,197,646 A 3/1993 Nikolich ..... 227/8
5,263,439 A 11/1993 Doherty et al. ..... 123/46
5,320,268 A * 6/1994 Shkolnikov et al. ..... 227/66
5,680,980 A * 10/1997 Robinson ..... 227/10
5,687,898 A * 11/1997 Toulouse ..... 227/8
5,713,313 A * 2/1998 Berry ..... 227/10

* cited by examiner

*Primary Examiner*—Lee Young
*Assistant Examiner*—Seau Smith
(74) *Attorney, Agent, or Firm*—Greer, Burns & Crain, LTD; Mark W. Croll; Lisa Soltis

(57) ABSTRACT

A suspension mechanism for mounting a combustion chamber fan motor in a combustion powered hand tool including a flexible rubber web secured between a motor retaining ring and a cylinder head mounting bracket. The suspension mechanism is tuned for at least one of reducing the axial acceleration of the motor and dampening the oscillation of the motor relative to the tool. The web includes concentric grooves on its upper and lower surface and a number of bores on the upper surface to provide the requisite flexibility depending on the characteristics of the tool.

24 Claims, 3 Drawing Sheets

61
66
48
C
58
56
31
50
34
46
30
44
42
10
60
12
86
49
120
16
84
36
20
114
98
100
14
102
110
88
94
118
96
104
116
112
18
108
28
106
22
90
26

COMBUSTION POWERED TOOL WITH IMPROVED COMBUSTION CHAMBER FAN MOTOR SUSPENSION

BACKGROUND OF THE INVENTION

The present invention relates generally to improvements in portable combustion powered fastener driving tools, and specifically to improvements relating to the suspension of a motor for a combustion chamber fan for decreasing the operationally-induced axial acceleration and oscillation of the motor to decrease wear and tear on the motor.

Portable combustion powered, or so-called IMPULSE® brand tools for use in driving fasteners into workpieces are described in commonly assigned patents to Nikolich U.S. Pat. Re. No. 32,452, and U.S. Pat. Nos. 4,522,162; 4,483,473; 4,483,474; 4,403,722, 5,197,646 and 5,263,439, all of which are incorporated by reference herein. Similar combustion powered nail and staple driving tools are available commercially from ITW-Paslode of Vernon Hills, Ill. under the IMPULSE® brand.

Such tools incorporate a generally pistol-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position, through differential gas pressures within the cylinder. Fasteners are fed magazine-style into the nosepiece, where they are held in a properly positioned orientation for receiving the impact of the driver blade.

Upon ignition of the combustible fuel/air mixture, the combustion in the chamber causes the acceleration of the piston/driver blade assembly and the penetration of the fastener into the workpiece if the fastener is present. This combined downward movement causes a reactive force or recoil of the tool body. Hence, the fan motor, which is suspended in the tool body, is subjected to an acceleration opposite the power stroke of the piston/driver blade and fastener.

Then, within milliseconds, the momentum of the piston/driver blade assembly is stopped by the bumper at the opposite end of the cylinder and the tool body is accelerated toward the workpiece. Therefore, the motor and shaft are subjected to an acceleration force which is opposite the direction of the first acceleration. After experiencing these reciprocal accelerations, the motor oscillates with respect to the tool.

Conventional combustion powered tools of the IMPULSE® type require specially designed motors to withstand these reciprocal accelerations of the shaft and motor, and the resulting motor oscillations. Among other things, the motors are equipped with internal shock absorbing bushings, thrust and wear surfaces, and overall heavier duty construction. Such custom modifications result in expensive motors which increase the production cost of the tools. Thus, there is a need for a motor suspension mechanism for a combustion powered tool which reduces operating demands on the motor, increases reliability of the motor, and allows the use of standard production fan motors to reduce the tool's production cost.

Accordingly, it is an object of the present invention to provide an improved combustion powered tool with an improved suspension mechanism for a combustion chamber fan motor which reduces operationally-induced reciprocal accelerations of the motor while keeping the oscillations of the motor within an acceptable range.

Another object of the present invention is to provide an improved combustion powered tool which features a mechanism for dampening operationally-induced oscillation of the combustion chamber fan motor.

A further object of the present invention is to provide an improved combustion powered tool having a suspension mechanism for a combustion chamber fan motor which allows for the use of a more standard, cost-effective motor.

It is yet another object of the present invention to provide an improved combustion powered tool having a suspension mechanism for a combustion chamber fan motor which increases the life of the motor.

BRIEF SUMMARY OF THE INVENTION

The above-listed objects are met or exceeded by the present improved combustion powered fastener tool, which features a mechanism for suspending a combustion chamber fan motor that reduces the effects of the reciprocal axial acceleration of the motor, and the resulting oscillation of the motor, during operation of the tool. In the preferred embodiment, the assembly includes a flexible rubber web vulcanized to a motor retaining ring. The web is also vulcanized to a cylinder head mounting bracket so that only the web secures the ring to the bracket. The web is thinner in the middle than the radial inner and outer portions, and has a number of bores extending at least partially through the middle portion. As such, the present motor suspension mechanism is more flexible than conventional mechanisms. It has been found that a suspension mechanism which is more flexible, yet tuned to the input dynamics, significantly reduces and dampens accelerations and oscillations.

More specifically, the present invention provides a suspension mechanism for a motor of a combustion chamber fan in a combustion powered hand tool constructed and arranged for driving a driver blade to drive a fastener into a work piece, the tool generating an upward axial acceleration of the motor upon a combustion in the chamber, a subsequent reciprocal axial acceleration of the motor when the piston bottoms out on the bumper, and at least one of the accelerations causes the motor to oscillate relative to the tool. The present suspension mechanism is tuned for at least one of reducing the axial acceleration of the motor and dampening the oscillation of the motor relative to the tool.

The web of the present invention preferably has an upper surface with a number of bores and a lower surface with an undercut annular groove. The suspension mechanism limits the two axial accelerations experienced by the motor, during combustion and piston/bumper contact, to no more than about 50 g and dampens the subsequent oscillations of the motor to no additional oscillations with accelerations greater than about 25 g.

DETAILED DESCRIPTION OF THE INVENTION

Figure 1:
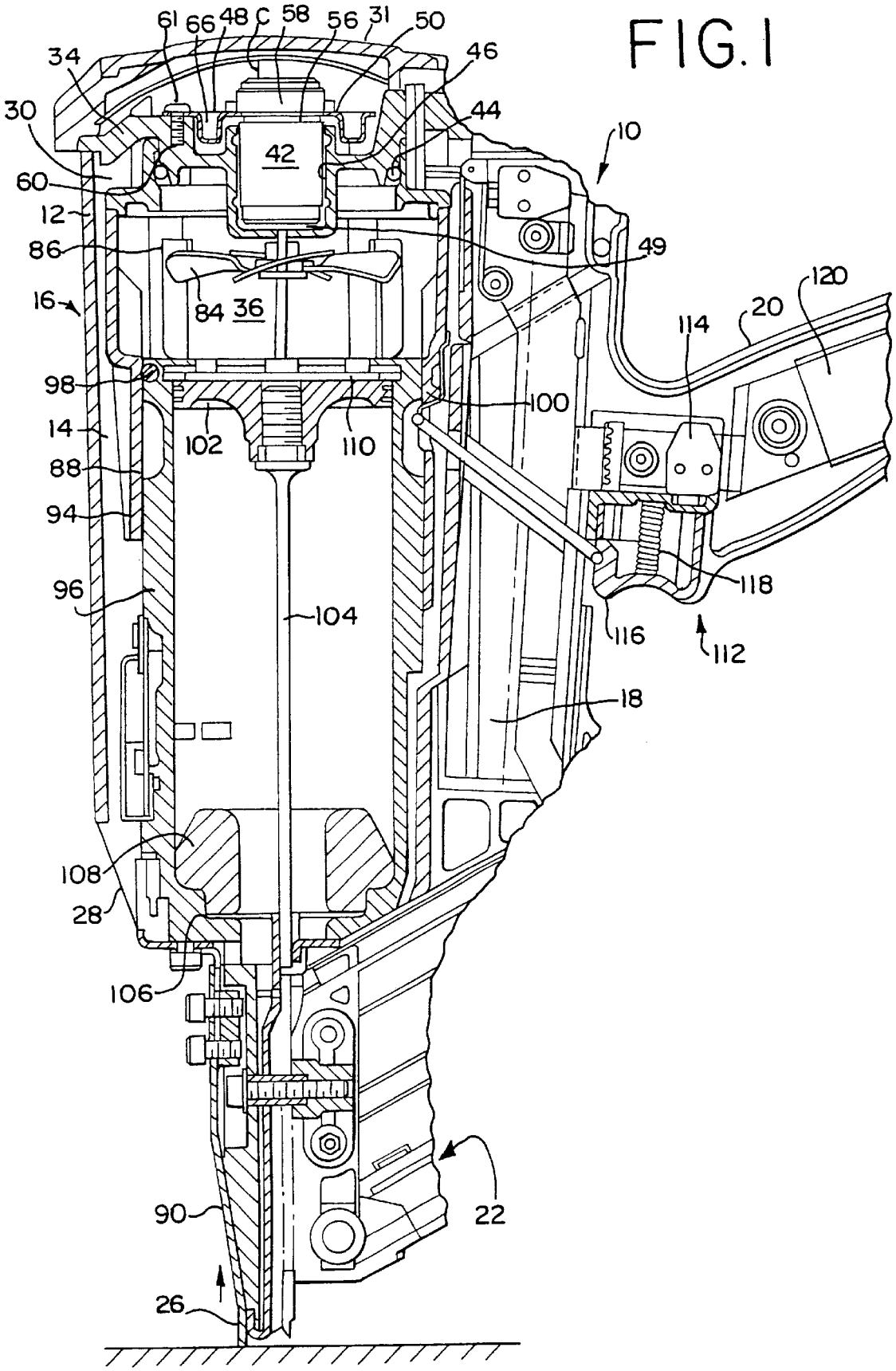
FIG. 1 is a fragmentary side view of a combustion powered fastener tool in accordance with the present invention, the tool being partially cut away for purposes of clarity.

Referring now to FIG. 1, a combustion powered tool of the type suitable for use with the present invention is generally designated 10. The tool 10 has a housing 12 including a main power source chamber 14 dimensioned to enclose a self-contained internal combustion power source 16, a fuel cell chamber 18 generally parallel with and adjacent to the main chamber 14, and a handle portion 20 extending from one side of the fuel cell chamber and opposite the main chamber.

In addition, a fastener magazine 22 is positioned to extend generally parallel to the handle portion 20 from an engagement point with a nosepiece 26 depending from a lower end 28 of the main chamber 14. A battery (not shown) is provided for providing electrical power to the tool 10, and is releasably housed in a compartment (not shown) located on the opposite side of the housing 12 from the fastener magazine 22. Opposite the lower end 28 of the main chamber is an upper end 30. A cap 31 covers the upper end 30 and is releasably fastened to the housing 12 to protect the fan motor and spark plug. As used herein, "lower" and "upper" are used to refer to the tool 10 in its operational orientation as depicted in FIG. 1; however it will be understood that this invention may be used in a variety of orientations depending on the application.

A mechanically linked fuel metering valve (not shown), such as that shown in U.S. Pat. No. 4,483,474 may be used. Alternatively, an electromagnetic, solenoid type fuel metering valve (not shown) or an injector valve of the type described in commonly assigned U.S. Pat. No. 5,263,439 is provided to introduce fuel into the combustion chamber as is known in the art. A pressurized liquid hydrocarbon fuel, such as MAPP, is contained within a fuel cell located in the fuel cell chamber 18 and pressurized by a propellant as is known in the art.

Figure 3:
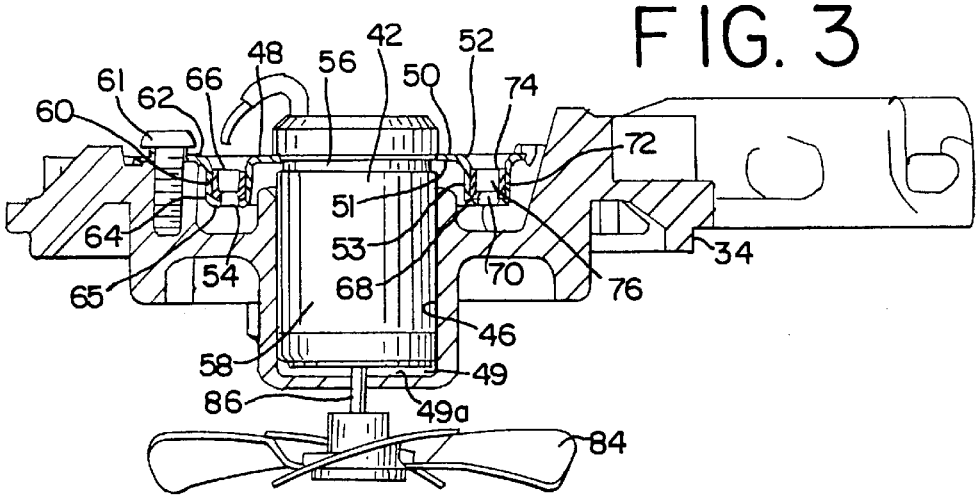
FIG. 3 is a cross-sectional side view of the cylinder head and suspension mechanism of the present invention taken along the line 3—3 of FIG. 2.
Figure 2:
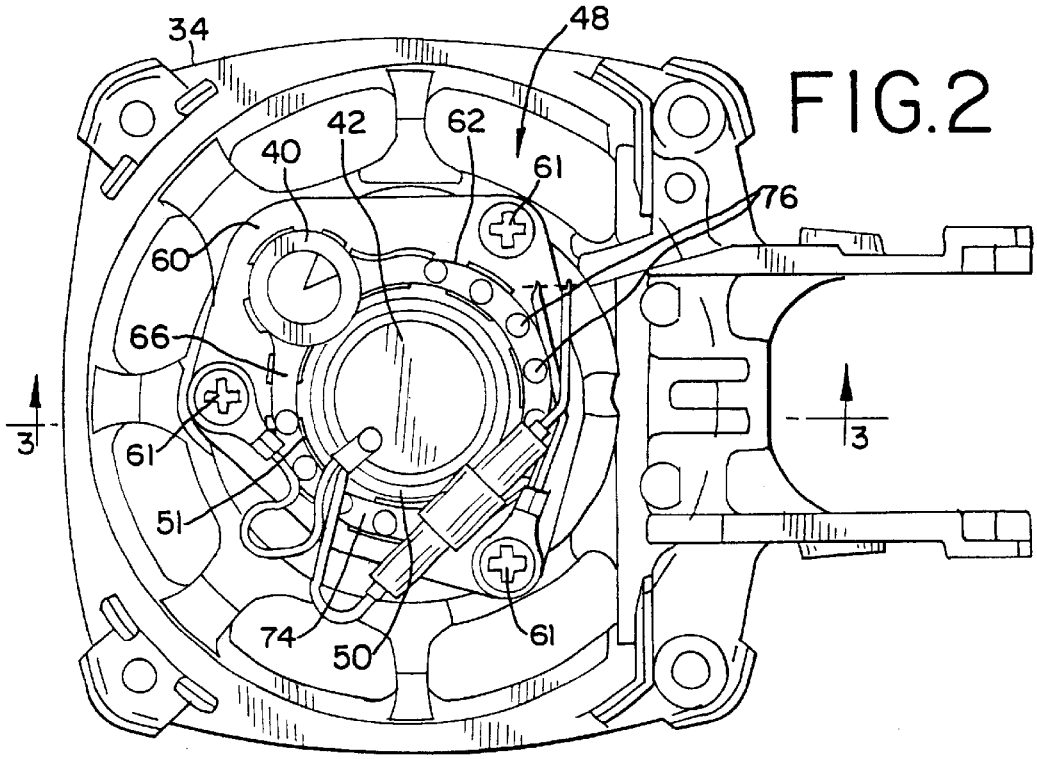
FIG. 2 is a top elevational view of the cylinder head of the tool depicted in FIG. 1, with the suspension mechanism and combustion chamber fan motor according to the present invention.

Referring now to FIGS. 1,2, and 3, a cylinder head 34, disposed at the upper end 30 of the main chamber 14, defines an upper end of a combustion chamber 36, and provides a spark plug port 40 (shown in FIG. 2 only) for a spark plug (not shown), an electric fan motor 42, and a sealing O-ring 44. The fan motor 42 is slidingly suspended within a depending cavity 46 in the center of the cylinder head 34 by a fan motor suspension mechanism 48 to allow for some longitudinal movement of the motor. As is best seen in FIG. 3, the motor 42 is preferably retained in the cavity 46 so that an air gap 49 is created between a lower end of the motor and a floor 49*a* of the cavity 46. One of the distinguishing features of the present tool 10 is that the gap 49 has been increased appropriately as measured in the direction of the longitudinal axis of the motor 42 to provide operating dynamic clearance, i.e., to provide clearance for the motor during oscillations occurring in the course of operation. In addition, at the upper end of the motor 42, a clearance "C" (best seen in FIG. 1) between the motor and an underside of the cap 31 has also been increased appropriately. These increased clearances allow for additional longitudinal movement of the motor and prevent damage to the motor 42 through operationally induced motor dynamics as described above which can cause excessively high accelerations to the motor when it impacts, or tops out against the floor of the cavity or the cap.

Figure 4:
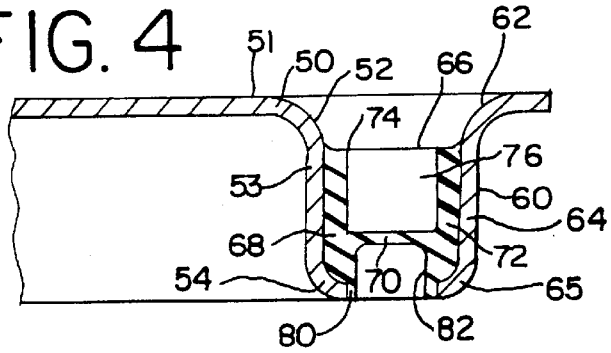
FIG. 4 is an enlarged cross-sectional side view of a portion of the suspension mechanism seen in FIG. 3.

Referring now to FIGS. 3 and 4, in a preferred embodiment, the assembly 48 includes a rigid, circular motor retaining ring 50 having an inner, annular planar portion 51, a rounded exterior shoulder 52, and a depending sidewall 53 having a radially extending lip 54 at its lower end. It can be appreciated that other shapes for the ring 50 may be used in tools having different combustion chamber head shapes and alternatives for mounting the rubber to metal. For example, in some combustion tool applications, the motor retaining ring 50 may be generally vertical in orientation, and lacking the annular planar portion 51 and the shoulder 52. In such cases, the ring 50 may still be secured to the motor 42 by snap clips. Received in and secured to the ring 50 is the motor 42. A groove 56 in a sidewall 58 of the motor 42 receives two snap clips (not shown), above and below the planar portion 51 of the ring 50, to secure the motor 42 to the ring 50.

The assembly 48 also includes a mounting bracket 60 which is secured to the cylinder head 34 by three threaded fasteners 61. As best seen in FIGS. 3 and 4, the bracket 60 includes an inner rounded shoulder 62, and depending sidewall 64 with a radially inwardly extending lip 65. The shoulder 62 and the sidewall 64 of the bracket 60 are concentric with and radially spaced from the shoulder 52 and the depending sidewall 53 of the ring 50. Between and integrally secured to the depending sidewalls 53 and 64 is a resilient web 66 having an inner portion 68 secured to the sidewall 53, a middle portion 70, and an outer portion 72 secured to the sidewall 64. In the preferred embodiment, the web 66 is rubber which is vulcanized to the ring 50 and the bracket 60. However, it is contemplated that other materials and bonding methods as are known in the art will provide the necessary adhesion and flexibility properties similar to those of rubber.

As best shown in FIG. 4, the web 66 is secured to the sidewalls 53 and 64 below the shoulders 52 and 62 such that an upper surface 74 of the web forms an annular dish-like groove or recessed area. It will be seen that the web 66 is the only structure provided for securing the head mounting bracket 60 to the motor retaining ring 50. Also, in the preferred embodiment, the upper surface 74 preferably has a plurality of equidistantly spaced, descending bores 76 extending at least partially through the middle portion 70. In the preferred embodiment, the bores 76 are blind, in that they do not extend entirely through the middle portion 70. This construction is preferred as a manufacturing technique to prevent rubber flashings created by molding throughbores from becoming detached from the web 66 and falling into the engine. A lower surface 80 of the web 66 has an annular groove 82 which is configured such that the groove does not communicate with the bores 76. As shown in FIG. 2, the web 66 and a part of the planar portion 51 of the ring 50 are interrupted, and do not form complete circles, to allow for the port 40 for installing a spark plug (not shown).

In operation, the web 66 provides a shock absorbing and isolating system to minimize the operational dynamics of the main chamber 14 caused by the combustion on the motor and also to protect the motor from axial acceleration and large oscillations. Although the preferred embodiment includes the bores 76 in the top surface 74 and the annular groove 82 in the lower surface 80, it is contemplated that the bores and the groove could be in either surface 74, 80, and that the depth of the groove 82 may vary. The depth and orientation of the bores 76 may vary with the application. For example, a second set of bores may also be provided to the web 66 so that they open toward the lower surface 80. Also, the depth of the groove 82 may vary with the application. Further, it is contemplated that several other patterns or other durometers for the rubber for the web would provide similar shock absorbing characteristics. Therefore, the bores 76 do not necessarily need to be round nor the grooves or recessed areas 74, 82 annular, nor do all of the bores need to be in the top surface 74 characterized by rounded corners to prevent tearing.

As shown in FIGS. 1 and 3, a combustion chamber fan 84, is driven by a shaft 86 on the motor 42, and is located within the combustion chamber 36 to enhance the combustion process and to facilitate cooling and scavenging. The fan motor 42 is preferably controlled by a head switch and/or trigger switch (not shown), as disclosed in more detail in the prior patents incorporated by reference.

As shown in FIG. 1, the generally cylindrical, combustion chamber 36 opens and closes by sliding motion valve member 88 which is moved within the main chamber 14 by a workpiece contacting element 90 on the nosepiece 26 using a linkage in a known manner. The valve member 88 serves as a gas control device in the combustion chamber 36, and sidewalls of the combustion chamber are defined by the valve member 88, the upper end of which sealingly engages the O-ring 44 to seal the upper end of the combustion chamber. A lower portion 94 of the valve member 88 circumscribes a generally cylindrical cylinder body or cylinder 96. An upper end of the cylinder body 96 is provided with an exterior O-ring 98 which engages a corresponding portion 100 of the valve member 88 to seal a lower end of the combustion chamber 36.

Within the cylinder body 96 is a reciprocally disposed piston 102 to which is attached a rigid, elongate driver blade 104 used to drive fasteners (not shown), suitably positioned in the nosepiece 26, into a workpiece (not shown). A lower end of the cylinder body defines a seat 106 for a bumper 108 which defines the lower limit of travel of the piston 102. At the opposite end of the cylinder body 96, a piston stop retaining ring 100 is affixed to limit the upward travel of the piston 102.

Located in the handle portion 20 of the housing 12 are the controls for operating the tool 10. A trigger switch assembly 112 includes a trigger switch 114, a trigger 116 and a biased trigger return member 118. An electrical control unit 120 under the control of the trigger switch 114 activates the spark plug (not shown) in the port 40.

As the trigger 116 is pulled, a signal is generated from the central electrical distribution and control unit 120 to cause a discharge at the spark gap of the spark plug, which ignites the fuel which has been injected into the combustion chamber 36 and vaporized or fragmented by the fan 84. This ignition forces the piston 102 and the driver blade 104 down the cylinder body 96, until the driver blade contacts a fastener and drives it into the substrate as is well known in the art. The piston then returns to its original, or "ready" position through differential gas pressures within the cylinder, which are maintained in part by the sealed condition of the combustion chamber 36.

The fan motor 42 experiences several accelerations during this cycle. First, when the ignition of combustible gases in the chamber 36 forces the piston 102 downwardly toward the workpiece, and preferably a fastener into the workpiece, the tool 10 experiences an opposing upward force, or a recoil force, in the opposite direction. The fan motor 42, which is suspended by the assembly 48 in the tool, is accelerated upwardly in the direction of the recoil of the tool by a force transmitted through the suspension mechanism. Further, the shaft 86 is accelerated in the same direction by having constrained movement relative to the motor within limits of axial play. Then, in less than approximately 20 milliseconds, the piston 102 bottoms-out in the cylinder 96 against the bumper 108. This action changes the acceleration of the tool 10 towards the workpiece. Therefore, the motor and shaft are now accelerated in this new, opposite direction. These reciprocal accelerations are repeatable and the suspension mechanism must be tuned so that the motor does not oscillate excessively with respect to the tool and either bottom out or top out as discussed earlier. By "tuned" it is meant that the resilience of the suspension mechanism is adjusted to prevent a particular motor from excessive oscillation within predetermined, application-specific limits, depending on the combustion-induced force generated by the particular power source 16. The present tuned suspension mechanism 48 anticipates the two opposite accelerations separated by a predetermined fairly repeatable time and resiliently constrains the motor within the bounds of the cap and the floor of the cavity to minimize the acceleration force of "g's" witnessed by the motor.

In tools prior to the present invention, the operationally-induced reciprocal axial accelerations, lack of tuning in the suspension mechanism and resulting oscillation of the motor 42 and the shaft 86 caused interior damage to the motor. Accordingly, as part of a quality tool with an extended work life, the motors required expensive custom assembly with interior shock absorbing features, particularly features to hold the shaft within the motor. The improved motor suspension mechanism of the present invention, including the mounting ring 50, the head mounting bracket 60 and the web 66, eliminates the need for this type of motor, since the invention provides for reduced acceleration and only dynamically induced loads of the motor, thereby decreasing the need for motor that will withstand the previously experienced extreme conditions.

Figure 5:
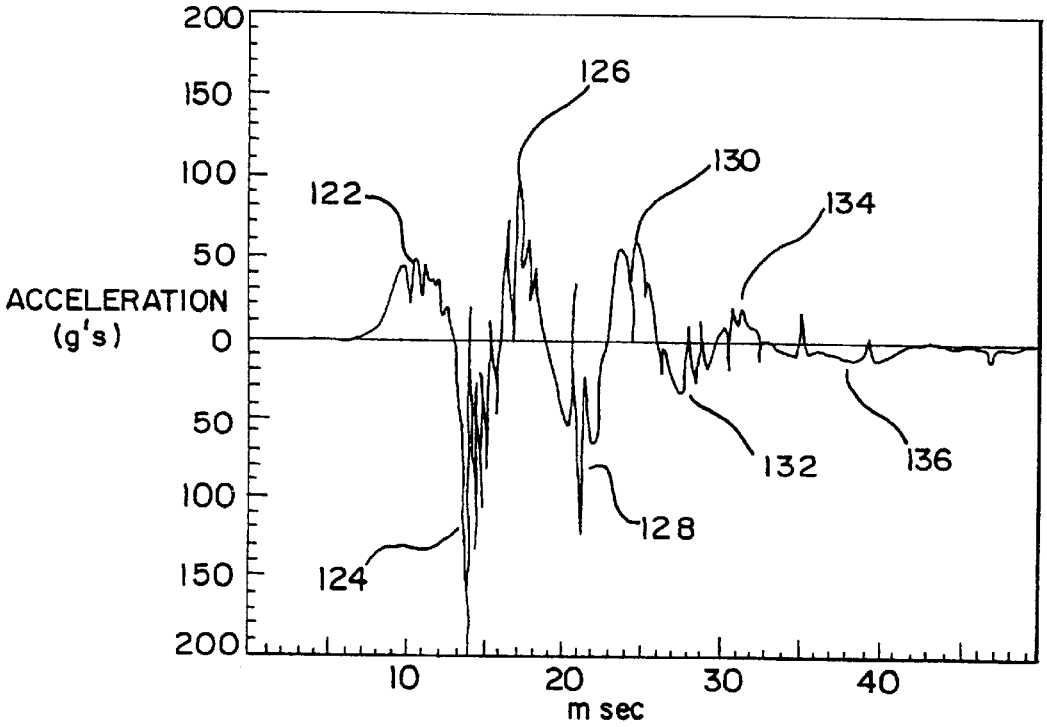
FIG. 5 PRIOR ART
FIG. 5 is a graph showing the operationally-induced acceleration and oscillation of a conventionally-suspended prior art combustion chamber fan motor in a combustion powered hand tool. The X-axis represents time in milliseconds and the Y-axis represents accelerations in g's measured by an accelerometer.
Figure 6:
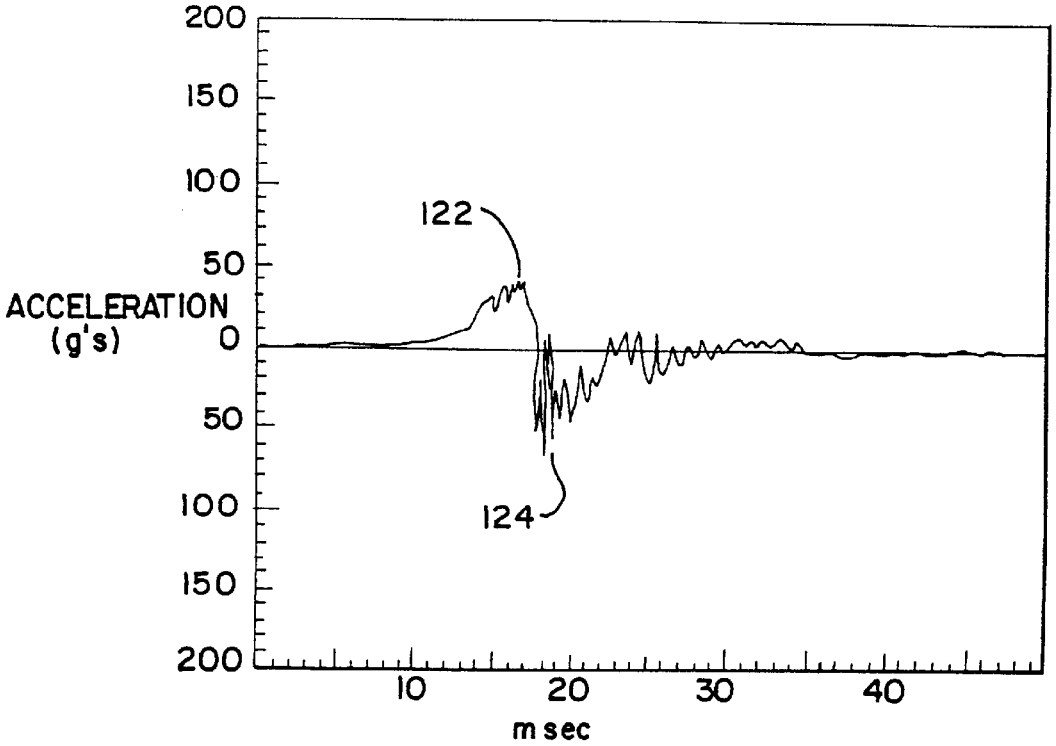
FIG. 6 is a graph of the type in FIG. 5 showing the performance of a combustion powered hand tool equipped with the improved motor suspension of the present invention.

FIGS. 5 and 6 show the acceleration and oscillation experienced by the motor during operation of the tool. The results shown in FIG. 5 are from a prior art tool without the benefit of the present invention, and having a conventional, relatively rigid suspension. As shown, at about 10 milliseconds after ignition, shown at 122, the motor experienced an acceleration force of about 40 g from the acceleration of the tool due to the recoil force which was immediately transmitted to the motor through the conventional, relatively rigid motor suspension mechanism. At about 14 milliseconds, shown at 124, the motor experienced an acceleration in the opposite direction of about 150 g when the piston 102 bottomed-out in the cylinder 96 which was again immediately transmitted by the motor. Thereafter, the motor experienced an oscillation of approximately four additional accelerations greater than 25 g's, labeled as 126, 128, 130 and 132 caused by its lack of tuning of the suspension mechanism. It was previously thought that a relatively rigid motor suspension mechanism was required in order to keep the amplitude of the oscillation of the motor within operational limits and keep the motor from bottoming out or topping out.

FIG. 6 shows the acceleration and oscillation experienced by the motor 42 in a tool 10 equipped with the present improved fan motor suspension mechanism. After ignition, the first acceleration 122 of the motor 42 was about 35 g and the reciprocal acceleration 124 was only about 50 g. Thereafter, the motor 42 experienced no additional accelerations above 25 g's. The tuned, less rigid suspension mechanism 48 causes less immediately transmitted acceleration, while also not allowing excessive amplitude of oscillation so there is no bottoming out or topping out. More specifically, the improved suspension mechanism provides for an axial acceleration of the motor of no more than about 80 g when the tool is fired with a nail.

A main difference between the present suspension mechanism 48 and prior art assemblies is that the resilient web 66 is of reduced mass, and as such is more flexible. Consequently, the motor 42 is held in the tool 10 in a less rigid manner than previously. The more flexible resilient web 66 also provides adequate properties for returning the motor 42 to its original operating position prior to the next firing sequence in all operating temperature conditions.

The result of the present invention is that the improved fan motor suspension mechanism 48 not only decreases acceleration of the motor 42, but also decreases the overall travel or displacement of the motor and the amount of oscillation of the motor. One would expect that an assembly which allows for greater flexibility, would allow greater oscillation. However, as shown in FIGS. 5 and 6, due to proper tuning, the improved motor suspension mechanism 48 decreases acceleration and also dampens oscillation and dynamically operates without detrimental contact within the positive constraints of the tool 10 (bottoming or topping out). A major benefit of this discovery is that the motor 42 need not be custom designed to provide for the severe acceleration forces generated by the tool 10. Instead, with the suspension mechanism 48 able to absorb the acceleration and dampen the oscillation, a less expensive motor may be provided, which reduces the overall manufacturing cost of the tool without impairing performance.

While a particular embodiment of the combustion powered tool with improved chamber fan motor suspension of the invention has been shown and described, it will be appreciated by those skilled in the art that changes and modifications may be made thereto without departing from the invention in its broader aspects and as set forth in the following claims.

What is claimed is:

1. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining ring defining a space for accepting the motor, a head mounting bracket radially spaced from the ring and configured for attachment to a cylinder head of the combustion chamber, and a flexible web disposed between said retaining ring and said mounting bracket, said flexible web including dampening means for maintaining the upward and reciprocal axial accelerations of the motor below no more than about 80 g when the tool is fired with a fastener, and being configured to maintain motor oscillations subsequent to the upward and reciprocal accelerations below 50 g's;

whereby increased flexibility of said flexible web provided by said dampening means reduces the axial acceleration and the motor oscillations relative to the housing and handle portion of the tool prior to a subsequent combustion in the combustion chamber.

2. The suspension mechanism according to claim 1, wherein said flexible web is integrally secured to said motor retaining ring and said head mounting bracket.

3. The suspension mechanism according to claim 2 wherein said flexible web is rubber vulcanized to said ring and said bracket.

4. The suspension mechanism according to claim 1, wherein said motor retaining ring has a depending sidewall concentric with a depending sidewall of said head mounting bracket, and said web is integrally secured to said sidewalls.

5. The suspension mechanism according to claim 4 wherein said flexible web is rubber vulcanized to said sidewalls.

6. The suspension mechanism according to claim 1, wherein said web has an upper surface with a groove concentric with and located between said sidewalls.

7. The suspension mechanism according to claim 1, wherein said web has a bottom surface with an undercut annular grove concentric with and located between said sidewalls.

8. The suspension mechanism according to claim 6 wherein said groove in said upper surface of said web further includes a plurality of depending bores.

9. The suspension mechanism according to claim 1, wherein said web has an upper surface with a groove concentric with and located between said ring and said bracket, a bottom surface with an undercut annular groove concentric with and located between said ring and said bracket, and a plurality of bores in at least one of said grooves.

10. The suspension mechanism according to claim 9 wherein said bores are blind.

11. The suspension mechanism as defined in claim 1 wherein said reciprocal acceleration is limited to two accelerative inputs into said mechanism.

12. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining ring defining a space for accepting the motor, a head mounting bracket radially spaced from the ring and configured for attachment to a cylinder head of the combustion chamber, and a flexible web disposed between said retaining ring and said mounting bracket;

said flexible web including dampening means being constructed and arranged for maintaining all subsequent motor oscillations subsequent to said upward and reciprocal accelerations below 25 g's;

whereby increased flexibility of said flexible web provided by said dampening means reduces the axial acceleration of the motor relative to the housing and handle portion of the tool prior to a subsequent combustion in the combustion chamber.

13. The suspension mechanism according to claim 12 wherein said suspending means provides for an axial acceleration of the motor of no more than about 80 g when the tool is fired with a nail.

14. The suspension mechanism according to claim 12 wherein said suspending means includes a flexible web integrally secured to a motor retaining ring and a head mounting bracket radially spaced from said ring so that said web secures to said ring to said bracket.

15. The suspension mechanism according to claim 14 wherein said web has an inner portion, an outer portion, and a middle portion, said middle portion being thinner than said inner and outer portions.

16. The suspension mechanism according to claim 15 wherein said middle portion of said web has a plurality of bores.

17. The suspension mechanism according to claim 14 wherein said web is interrupted to allow for insertion of a spark plug into the combustion chamber.

18. The suspension mechanism according to claim 16 wherein said bores are all located on one of an upper and a lower surface of said middle portion.

19. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, respective to a starting position of the motor, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining ring defining a space for accepting the motor, a head mounting bracket radially spaced from the ring and configured for attachment to a cylinder head of the combustion chamber, and a flexible web disposed between said retaining ring and said mounting bracket, said suspension mechanism being constructed and arranged to return the motor to its pre combustion starting position prior to the next combustion, wherein said suspension mechanism flexible web is provided with dampening means constructed and arranged for dampening an axial acceleration of the motor to no more than about 80 g when the tool is fired with a fastener, and being configured for maintaining motor oscillations subsequent to the upward and reciprocal accelerations below 50 g's;

wherein increased flexibility of said flexible web provided by said dampening means reduces the motor vibrations relative to the housing and handle portion of the tool prior to a subsequent combustion in the combustion chamber.

20. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining ring defining a space for accepting the motor, a head mounting bracket radially spaced from the ring and configured for attachment to a cylinder head of the combustion chamber, and a flexible web disposed between said retaining ring and said mounting bracket;

said flexible web being integrally secured to said motor retaining ring and said head mounting bracket so that said motor retaining ring is secured to said mounting bracket only by said web so that said motor is radially surrounded by said web in a transverse direction to the axial acceleration of the tool, said flexible web being provided with dampening means for maintaining motor oscillations subsequent to the upward and reciprocal accelerations below 50 g's;

wherein increased flexibility of said flexible web provided by said dampening means reduces the motor vibrations relative to the housing and handle portion of the tool prior to a subsequent combustion in the combustion chamber.

21. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining defining a space for accepting the motor, a head mounting bracket radially spaced from the ring and configured for attachment to a cylinder head of the combustion chamber, and a flexible web disposed between said retaining ring and said mounting bracket, said web being provided with dampening means for providing at least one of reduced mass and material of increased flexibility, said motor retaining ring having a depending sidewall concentric with a depending sidewall of said head mounting bracket so that said motor is radially surrounded by said web in a transverse direction to the axial acceleration of the tool, said dampening means being configured for maintaining the upward and reciprocal axial accelerations of the motor below no more than about 80 g when the tool is fired with a fastener, and being configured for maintaining motor oscillations subsequent to the upward and reciprocal accelerations below 50 g's;

whereby increased flexibility of said flexible web provided by said dampening means reduces the axial acceleration and the motor oscillations relative to the housing and handle portion of the tool prior to a subsequent combustion in the combustion chamber.

22. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

said suspension mechanism having a rigid motor retaining ring defining a space for accepting the motor, a head mounting bracket radially spaced from the ring and configured for attachment to a cylinder head of the combustion chamber, and a flexible web disposed between said retaining ring and said mounting bracket so that said motor is radially surrounded by said web in a transverse direction to the axial acceleration of the tool, said web being provided with dampening means for maintaining the upward and reciprocal axial accelerations of the motor below no more than about 80 g when the tool is fired with a fastener, and being configured to maintain motor oscillations subsequent to the upward and reciprocal accelerations below 50 g's, said dampening means including providing said web with an upper surface with a groove concentric with and located between said sidewalls, and said groove including a plurality of depending bores; whereby increased flexibility of said web provided by said dampening means reduces the axial acceleration and the motor oscillations relative to the housing and handle portion of the tool prior to a subsequent combustion in the combustion chamber.

23. A suspension mechanism for a motor of a combustion chamber fan in a combustion powered hand tool having a unitary housing and handle portion, said housing enclosing a combustion chamber, the tool constructed and arranged for driving a driver blade to drive a fastener into a work piece, the tool generating a single upward axial acceleration of the motor upon a combustion in the chamber, a subsequent reciprocal axial acceleration of the motor when a piston bottoms out on a bumper, at least one of the accelerations causing the motor to oscillate relative to the tool, said suspension mechanism comprising:

a rigid motor retaining ring defining a space for accepting the motor, a head mounting bracket radially spaced from the ring and configured for attachment to a cylinder head of the combustion chamber, and a flexible web disposed between said retaining ring and said mounting bracket so that said motor is radially surrounded by said web in a transverse direction to the axial acceleration of the tool;

said flexible web being provided with dampening means for maintaining the upward and reciprocal axial accelerations of the motor below no more than about 80 g when the tool is fired with a fastener, and being configured to maintain motor oscillations subsequent to the upward and reciprocal accelerations below 50 g's, said dampening means including providing an upper surface of said web with a groove concentric with and located between said ring and said bracket, a bottom surface with an undercut annular groove concentric with and located between said ring and said bracket, and a plurality of bores in at least one of said grooves for restricting the axial movement of the motor relative to said head mounting bracket;

whereby increased flexibility of said web provided by said dampening means reduces the axial acceleration and the motor oscillations relative to the housing and handle portion of the tool prior to a subsequent combustion in the combustion chamber.

24. The suspension mechanism of claim 23 wherein said bores are blind.

* * * * *